US005810236A

United States Patent [19]

Yoshida et al.

[11] Patent Number: 5,810,236

[45] Date of Patent: Sep. 22, 1998

[54] WEB ACCUMULATOR

[75] Inventors: Kiyomi Yoshida; Seiji Sato; Michio Ueda, all of Tokushima, Japan

[73] Assignee: Shikoku Kakoki Co., Ltd., Tokushima, Japan

[21] Appl. No.: 873,368

[22] Filed: Jun. 12, 1997

[30] Foreign Application Priority Data

Jun. 13, 1996 [JP] Japan ..... 8-152173

[51] Int. Cl.[6] ..... B65H 20/24; B65H 26/00

[52] U.S. Cl. ..... 226/118.3; 226/44

[58] Field of Search ..... 226/118.3, 44; 242/552; 384/49, 906

[56] References Cited

U.S. PATENT DOCUMENTS

| | | | |
|---|---|---|---|
| 3,669,375 | 6/1972 | Bruton | 242/552 X |
| 4,262,855 | 4/1981 | Haag | 242/552 X |
| 4,799,803 | 1/1989 | Tanaka | 384/49 X |
| 4,995,564 | 2/1991 | Zuliani | 226/118.3 X |
| 5,139,206 | 8/1992 | Butler | 226/44 X |
| 5,366,131 | 11/1994 | Hoffa et al. | 226/118.3 |

FOREIGN PATENT DOCUMENTS

| | | |
|---|---|---|
| 0 669 275 A1 | 8/1995 | European Pat. Off. . |
| 195 15 397 A1 | 11/1995 | Germany . |

OTHER PUBLICATIONS

Abstract of Application No. EP97201721.4.

*Primary Examiner*—Michael Mansen

*Attorney, Agent, or Firm*—Armstrong, Westerman, Hattori, McLeland, and Naughton

[57] ABSTRACT

A web accumulator having an even number of dancer rollers, arranged on either side of a single vertical guide rod for guiding the dancer roller for upward and downward movement. A support structure is provided on the guide rod so as to be movable upward and downward but not to rotate about an axis of the guide rod and supporting the dancer roller in a horizontal position. The support structure includes a lift sleeve fitting around the guide rod so as to be movable upward and downward while being prevented from rotating about the axis of the guide rod. A plurality of rolling members rollable along the vertical guide rod are provided between the guide rod and the lift sleeve and rollably retained on the lift sleeve.

11 Claims, 4 Drawing Sheets

WEB ACCUMULATOR

BACKGROUND OF THE INVENTION

1. Field of the Invention

The present invention relates to web accumulators, and more particularly to an accumulator for use in packaging machines, wherein a web serving as a packaging material is finally made into rectangular parallelepipedal containers by forming the web into a tube, filling the tube with a flowable food or like contents and dividing the filled tube into lengths each corresponding to one container, the accumulator being adapted to accumulate the web as unwound from a coiled form so as to feed the web to the subsequent packaging process trouble-free or to avoid an interruption of the operation of the packaging machine by allowing some time for joining the tail end of a preceding web portion to the leading end of another web portion following the preceding portion.

2. Description of the Related Art

Such accumulators already known include those comprising at least one dancer roller, and guide means for guiding the dancer roller for upward and downward movement. The conventional accumulator guide means comprises two vertical guide rods for guiding the respective ends of the dancer roller as slidably fitted in a vertical guide groove formed in each rod, one comprising a roller rotatably mounted on each end of the dancer roller and two vertical guide rods each having a vertical guide groove for rollably fitting the roller therein, and one comprising a pinion mounted on each end of the dancer roller and two vertical guide rods each having a rack in mesh with the pinion. Also well known is another guide means which comprises a pair of pivotal arms for supporting the respective ends of the dancer roller.

The conventional accumulators require two vertical guide rods or two pivotal arms regardless of the type of guide means incorporated therein and therefore necessitate a large space.

When the guide means comprises two grooved vertical guide rods for slidably receiving therein the respective ends of the dancer roller, the opposite dancer roller ends are likely to differ from each other in the sliding resistance offered by the inner grooved face of the corresponding guide rod. This gives rise to a problem in which the dancer roller becomes inclined, failing to smoothly move up and down and permitting the web to travel in a zigzag fashion. In the case where a plurality of dancer rollers are used, the problem to be described below is also encountered in addition to the above problem. The sliding resistance between the opposite ends of the dancer roller and the grooved inner faces of the guide rods is likely to differ from roller to roller, consequently permitting the individual dancer rollers to move up and down at different levels to produce an undesirable influence on the performance of the accumulator. Thus, the accumulator fails to ensure an accurate amount of accumulation.

The same problem as is encountered by the guide means comprising two grooved vertical guide rods for slidably receiving therein the respective ends of the dancer roller is experienced also with the guide means comprising a roller rotatably mounted on each end of the dancer roller and two vertical guide rods each having a vertical guide groove for rollably fitting the roller therein, and with the guide means comprising a pinion mounted on each end of the dancer roller and two vertical guide rods each having a rack in mesh with the pinion, because the rollers or pinions on the respective ends of the dancer roller are likely to differ from each other in the rolling resistance offered by the inner groove face or the rack of the corresponding guide rod.

Furthermore, the guide means comprising a pair of pivotal arms for supporting the respective ends of the dancer roller has a problem especially with respect to space if it is attempted to make the dancer roller movable up and down over an increased stroke length since it is then necessary to lengthen the pivotal arms considerably. It is therefore impossible to greatly increase the stroke and accordingly to ensure a sufficient amount of accumulation. When a plurality of dancer rollers are used, moreover, the pairs of pivotal arms supporting the respective dancer rollers must be so arranged as to avoid interference with one another. This makes the accumulator complex in construction.

SUMMARY OF THE INVENTION

An object of the present invention is to provide a web accumulator which is free of the foregoing problems.

Other objects of the invention will become apparent as the description proceeds.

The present invention provides a web accumulator comprising at least one dancer roller, and guide means for guiding the dancer roller for upward and downward movement, the guide means comprising a single vertical guide rod, and support means provided on the guide rod so as to be movable upward and downward but not to rotate about an axis of the guide rod and supporting the dancer roller in a horizontal position.

Since the guide means has only one vertical guide rod, the web accumulator of the present invention permits a smaller installation space than the conventional accumulators wherein the guide means has two vertical guide rods or a pair of pivotal arms. The guide means further comprises support means movable upward and downward on the vertical guide rod but not rotatable about the axis of the guide rod and supporting the dancer roller in a horizontal position, so that the dancer roller is movable upward and downward always in a horizontal position, whereby the web can be prevented from traveling in a zigzag fashion.

With the accumulator described, the support means comprises a lift sleeve fitting around the vertical guide rod so as to be movable upward and downward while being prevented from rotating about the axis of the guide rod. It is desired that in this case, a plurality of rolling members rollable along the vertical guide rod be provided between the guide rod and the lift sleeve and rollably retained on the lift sleeve. Stated more specifically, the rolling members are preferably balls, and the vertical guide rod has a plurality of vertical ball guide grooves formed in an outer periphery thereof and spaced apart circumferentially thereof, the balls being rollable as fitted in the ball guide grooves. The balls are then rollable, permitting the lift sleeve to move smoothly upward and downward along the guide rod. Since the balls roll along as fitted in the ball guide grooves in the guide rod, there is no likelihood that the axis of the lift sleeve will incline relative to the axis of the guide rod or rotate about the guide rod axis. The dancer roller is therefore smoothly movable upward and downward while being held horizontal with its axis retained in a specified direction, precluding the web from traveling in a zigzag manner.

According to the present invention, the web is prevented from coming into contact with the guide rod or from interfering with the upward and downward movement of the dancer roller and the lift sleeve when slackening as reeved around the dancer roller. For this purpose, the web accumulator is provided with means for preventing the web from coming into contact with the vertical guide rod. When the web reeved around the dancer roller slackens in this case, the web comes into contact with the above means and is thereby prevented from contacting the vertical guide rod, whereby the lubricant applied to the guide rod can be precluded from adhering to the web.

The web accumulator embodying the present invention preferably has an even number of dancer rollers, more preferably two dancer rollers, in view of the ease of holding the rollers in balance under the force of gravity.

When there are two dancer rollers, the two dancer rollers are identical in construction and/or are arranged in parallel to each other with the vertical guide rod positioned therebetween.

When having two dancer rollers, the accumulator may also be provided with means for preventing the web from coming into contact with the vertical guide rod, for example, vertical rods, so as to prevent the web from coming into contact with the guide rod or from interfering with the upward and downward movement of the dancer rollers when the web slackens as it is reeved around the dancer rollers. If the web reeved around the dancer rollers slackens in this case, the web comes into contact with the vertical bars and is thereby prevented from contacting the vertical guide rod, whereby the lubricant applied to the guide rod can be precluded from adhering to the web.

In the case where the dancer rollers are two in number, the present invention is embodied as a web accumulator which comprises a single vertical guide rod formed in an outer periphery thereof with a plurality of vertical ball guide grooves spaced apart circumferentially thereof, a lift sleeve fitting around the vertical guide rod so as to be movable upward and downward while being prevented from rotating about an axis of the guide rod, a plurality of balls provided between the vertical guide rod and the lift sleeve and rollably retained on the lift sleeve, the balls being rollable as fitted in the ball guide grooves in the outer periphery of the guide rod, a horizontal support plate fixed to an upper end of the lift sleeve and formed at the middle of the length thereof with a hole having the vertical guide rod loosely inserted therethrough, the support plate being formed with two through-holes greater than the guide rod inserting hole and positioned closer to respective opposite ends of the support plate than the guide rod inserting hole, two brackets fixed to the respective opposite ends of the support plate, two dancer rollers arranged in parallel to each other with the vertical guide rod positioned therebetween and supported at opposite ends thereof by the brackets, the dancer rollers being identical in construction, and vertical rods having a greater diameter than the vertical guide rod, arranged on opposite sides of the guide rod and loosely inserted through the respective through holes of the support plate for preventing a web from coming into contact with the guide rod.

With this accumulator, the balls roll along, permitting the lift sleeve to smoothly move upward and downward along the vertical guide rod. Since the balls roll along as fitted in the ball guide grooves of the guide rod, there is no likelihood that the axis of the lift sleeve will incline relative to the axis of the guide rod, or the lift sleeve will rotate about the guide rod axis. Furthermore, the two dancer rollers of identical construction are arranged in parallel to each other with the vertical guide rod disposed therebetween, so that the two dancer rollers are held in good balance under gravity, with the guide rod positioned in the center of the arrangement of dancer rollers. As a result, the two dancer rollers are smoothly movable upward and downward while being held horizontal with their axes retained in a specified direction, thus preventing the web from traveling in a zigzag manner and ensuring an accurate amount of accumulation. If the web slackens as reeved around the dancer rollers, the web comes into contact with the vertical rods, which action precludes the contact of the web with the vertical guide rod, consequently preventing the lubricant applied to the vertical guide rod from adhering to the web.

The present invention will be described in greater detail with reference to the accompanying drawings.

DESCRIPTION OF THE PREFERRED EMBODIMENTS

Figure 1:
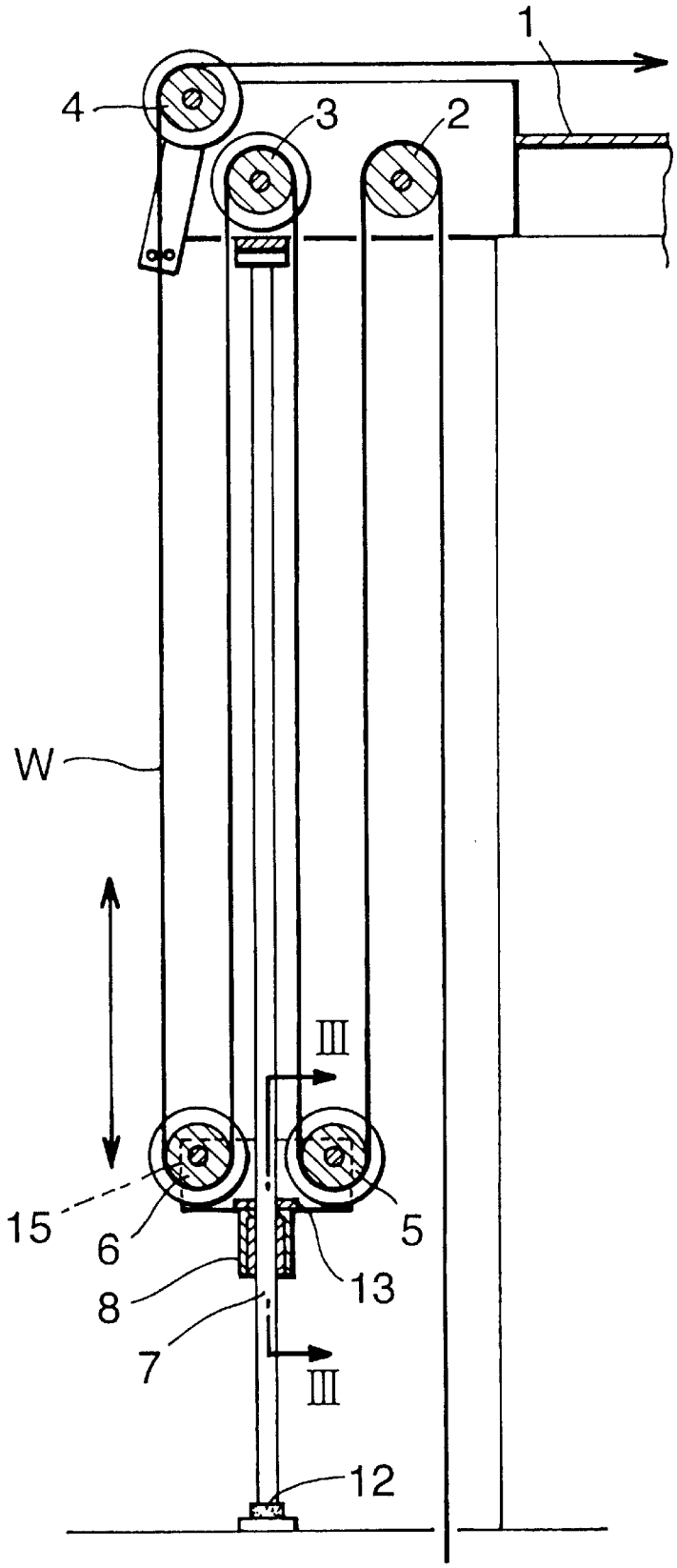
FIG. 1 is a vertical view sectional showing the overall construction of a web accumulator embodying the present invention.
Figure 2:
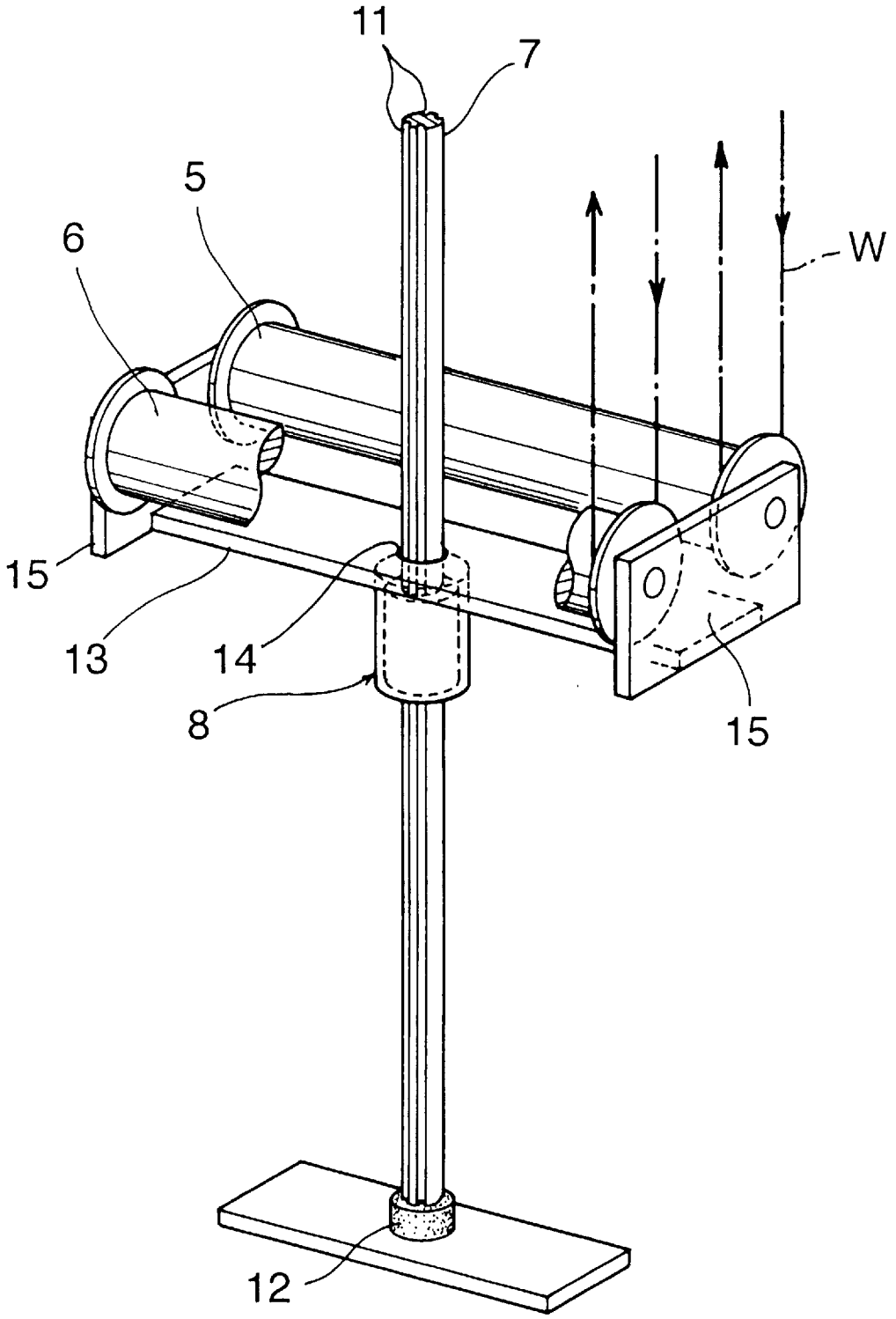
FIG. 2 is an enlarged perspective view partially broken away and showing dancer rollers of the accumulator and other components thereof around the rollers.
Figure 3:
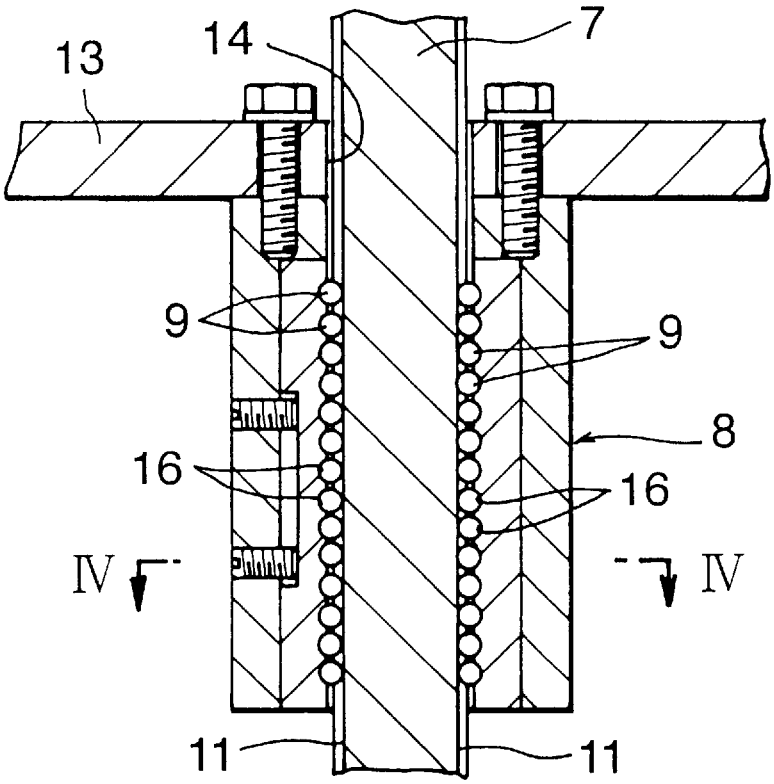
FIG. 3 is an enlarged view in section taken along the line III—III in FIG. 1.
Figure 4:
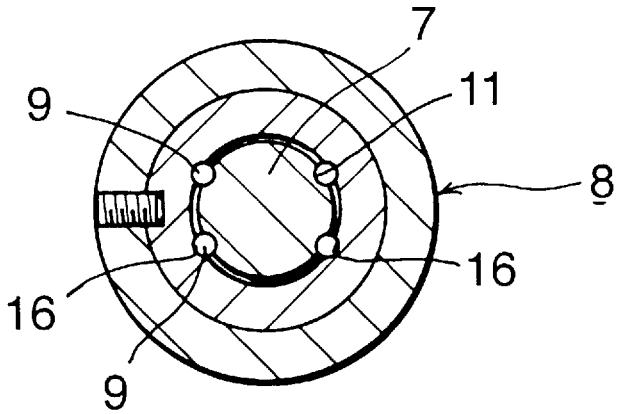
FIG. 4 is a view in section taken along the line IV—IV in FIG. 3.

In the following description, the left-hand side of FIG. 1 will be referred to as "front," the opposite side thereof as "rear," and the terms right and left are used for the accumulator as it is seen from the front looking rearward.

With reference to FIGS. 1 to 4 showing a first embodiment of the invention, i.e., an accumulator for a web W, the accumulator comprises a feed roller 2 extending in the right-to-left direction and disposed close to the upper front end of a frame 1, a rotatable first guide roller 3 extending in the right-to-left direction and disposed at the upper end of the frame 1 in front of, and at the same level as, the feed roller 2, a rotatable second guide roller 4 extending in the right-to-left direction and disposed at the upper end of the frame 1 obliquely above and forwardly of the first guide roller 3, rotatable first and second dancer rollers 5, 6 extending in the right-to-left direction and arranged at the same level under the space between the feed roller 2 and the first guide roller 3 and under the second guide roller 4, respectively, and guide means for guiding the two dancer rollers 5, 6 for upward and downward movement.

The web W extending upward as unwound from a coil of web (now shown) is successively reeved around the feed roller 2, first dancer roller 5, first guide roller 3, second dancer roller 6 and second guide roller 4.

The feed roller 2 is rotatable by suitable drive means (not shown) alternatively at one of high and low speeds. Assuming that the feed rate of the web W per unit time is termed a "standard feed rate," the feed roller 2 is set at either of the high and low speeds of rotation so that the rate of feed of the web W by the feed roller 2 rotated at the high speed by the drive means is not less than the standard feed rate, and such that the rate of feed of the web W by the feed roller 2 as rotated at the low speed is less than the standard feed rate.

The guide means comprises a single vertical guide rod 7 provided inside the frame 1, and support means provided on the guide rod 7 so as to be movable upward and downward while being prevented from rotating about the axis of the guide rod 7 and supporting the two dancer rollers 5, 6 in a horizontal position.

The vertical guide rod 7 is formed in its outer periphery with a plurality of vertical ball guide grooves 11 spaced apart circumferentially thereof. The guide rod 7 has a tubular cushion 12 fitted around the lower end thereof.

The support means comprises a lift sleeve 8 fitting around the vertical guide rod 7 so as to be movable upward and downward while being prevented from rotating about the axis of the guide rod 7 and supporting the two dancer rollers 5, 6 in the horizontal position at the same level. A plurality of balls 9 are provided between the guide rod 7 and the lift sleeve 8 and rollably retained on the lift sleeve 8. The balls 9 are rollable as fitted in the ball guide grooves 11 in the outer periphery of the guide rod 7.

Fixed to the upper end of the lift sleeve 8 is a horizontal plate 13 which is rectangular and elongated in the right-to-left direction. The guide rod 7 is loosely inserted through a hole 14 formed in the horizontal plate 13 at the middle of its length. Fixed respectively to the right and left ends of the plate 13 are two brackets 15 each in the form of a rectangular vertical plate elongated in the front-to-rear direction. The dancer rollers 5, 6 are arranged between the two brackets 15 at the rear and front end portions thereof, respectively, and are rotatably supported by the brackets 15. Accordingly, the two dancer rollers 5, 6 are supported in a horizontal position by the lift sleeve 8 by means of the horizontal plate 13 and brackets 15 so as to be at the same level. The two dancer rollers 5, 6 are identical in construction and are arranged in parallel to each other on the rear and front sides of the vertical guide rod 7, respectively. The two dancer rollers 5, 6 are at equal distances from the guide rod 7, and the opposite ends of the two dancer rollers 5, 6 are also at equal distances from the guide rod 7. The two dancer rollers 5, 6 are therefore held in good balance under gravity, with the weight distributed equivalently forward and rearward and leftward and rightward, as centered about the guide rod 7.

The balls 9 are rollably fitted in respective concave pockets 16 formed in the inner periphery of the lift sleeve 8 and arranged vertically at a spacing, and are thereby retained on the lift sleeve 8. Instead of forming the concave pockets 16 in the inner periphery of the lift sleeve 8, as spaced apart vertically for rollably fitting the balls 9 in, ball spline means may be provided between the guide rod 7 and the sleeve 8. More specifically, the lift sleeve 8 may be formed with circulation passageways which are equal in number to the number of ball guide grooves 11 of the guide rod 7, each of the passageways comprising a forward channel in the shape of a circular-arc groove formed in the sleeve 8 and facing the groove 11, a return channel in the shape of a vertically elongated bore formed in a portion of the sleeve 8 radially outwardly of the forward channel, and a semicircular turn channel formed in each of upper and lower end portions of the sleeve 8 and interconnecting the forward channel and the return channel. A plurality of balls are enclosed in each circulation passageway. Further alternatively, the lift sleeve 8 may be provided with a retainer having holelike pockets arranged vertically at a spacing and positioned in corresponding relation with the ball guide grooves 11 of the guide rod 7, with balls 9 rollably fitted in the respective pockets of the retainer.

Now, suppose the feed roller 2 is held in rotation at the high speed by the drive means. The rate of feed of the web W by the feed roller 2 is greater than the standard feed rate, so that a gradually increasing slack is produced in the web W between the feed roller 2 and the first guide roller 3, and between the first guide roller 3 and the second guide roller 4, allowing the lift sleeve 8 to descend along the vertical guide rod 7 and the two dancer rollers 5, 6 to descend under the force of gravity. A lower limit level sensor (not shown) then detects the lower limit position of the dancer rollers 5, 6, whereupon the sensor outputs a lower limit level signal. In response to this output signal, the drive means changes over the feed roller 2 to rotation at the low speed. The rate of feed of the web W by the feed roller 2 now decreases below the standard feed rate, resulting in a gradual diminution of the slack of web W between the feed roller 2 and the first guide roller 3, as well as between the first guide roller 3 and the second guide roller 4, so that the web W pulls the dancer rollers 5, 6 upward. An upper limit level sensor (not shown) then detects the upper limit position of the dancer rollers 5, 6 and produces an upper limit level signal. Based on this output signal, the drive means changes over the feed roller 2 to rotation at the high speed. Consequently, the rate of feed of the web W by the feed roller 2 exceeds the standard feed rate again, gradually increasing the slack of the web W between the feed roller 2 and the first guide roller 3 and between the first guide roller 3 and the second guide roller 4 and allowing the dancer rollers 5, 6 to descend under the force of gravity. In this way, the two dancer rollers 5, 6 repeatedly move upward and downward within the range of limit levels detected by the lower and upper limit level sensors, and in the meantime, the accumulator accumulates a specified length of the web W. The upward and downward movement of the dancer rollers 5, 6 is effected by the balls 9 retained on the lift sleeve 8 moving along the inner peripheral faces of the guide rod 7 defining the ball guide grooves 11 and the resulting upward and downward movement of the sleeve 8. Consequently, the lift sleeve 8 moves upward and downward smoothly without inclining relative to the axis of the guide rod 7 or rotating about the axis. Moreover, the two dancer rollers 5, 6 are identical in construction, arranged in parallel to each other with the guide rod 7 interposed therebetween, and spaced from the guide rod 7 by equal distances, with the opposite ends of the dancer rollers positioned also at equal distances from the guide rod 7. The two dancer rollers 5, 6 are therefore held in good balance under gravity, with the guide rod 7 in the center of the arrangement of dancer rollers 5, 6. This enables the two dancer rollers 5, 6 to smoothly move upward and downward while being held in a horizontal position with their axes retained in the right-to-left direction.

While the two dancer rollers 5, 6 move up and down repeatedly, the web W is always subjected to tension produced by the gravity acting on the dancer rollers 5, 6. Accordingly, substantially uniform tension acts on the web W when the web passes over the second guide roller 4, thereby reducing the tendency of the web W to slacken.

When the web W has been completely unwound from the coil of web, the end of the web W, i.e., of the preceding web W, is fixedly held by a joining device (not shown) so as to be joined to the leading end of another web W, i.e., of the following web W. At this time, the two dancer rollers 5, 6 are adapted to ascend to a point above the upper limit position to be detected by the upper limit level sensor. As a result, the portion of web W accumulated by the accumulator is sent out, permitting the packaging machine to operate continuously.

Figure 5:
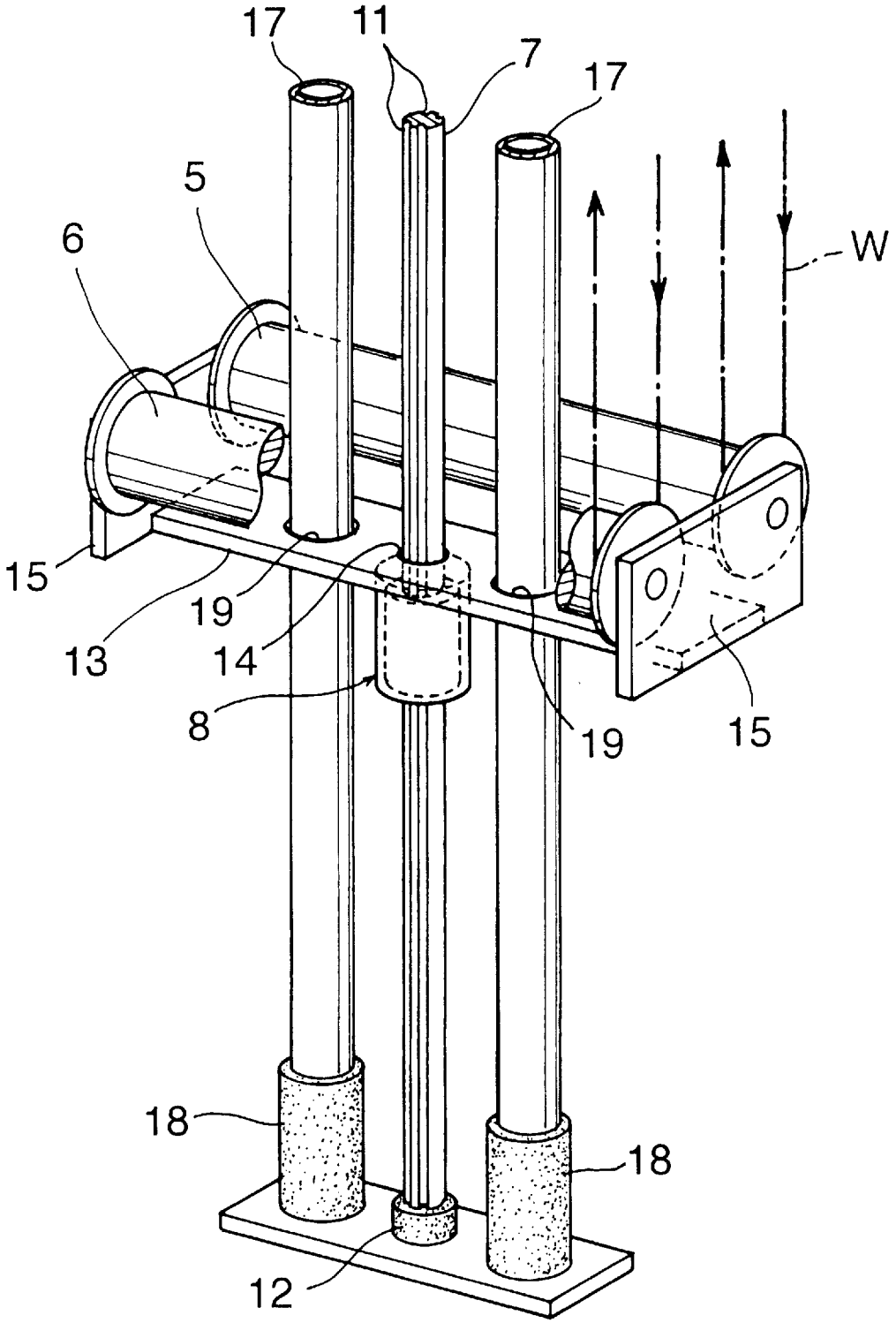
FIG. 5 is a view corresponding to FIG. 2 and showing another embodiment of the web accumulator of the present invention.

FIG. 5 shows another embodiment of the web accumulator in the present invention.

Vertical rods 17 having the same length as the vertical guide rod 7 are provided between the two brackets 15 respectively at the right and left sides of the rod 7. The axes of the guide rod 7 and the vertical rods 17 are aligned in the right-to-left direction. The vertical rods 17 are loosely inserted through respective through holes 19 formed in the horizontal plate 13 at opposite sides of the hole 14 therein. The through holes 19 are greater than the hole 14 in diameter. The vertical rods 17 are greater than the vertical guide rod 7 in diameter, such that when slackening, the web W comes into contact with the vertical rods 17 first, whereby the contact of the web W with the guide rod 7 is precluded. This prevents the lubricant applied to the guide rod 7 from adhering to the web W. Especially at the portion between the first guide roller 3 and the dancer rollers 5, 6, the surface of the web W positioned on opposite sides of, and facing, the guide rod 7 provides the inner surface of the container to be made by the packaging machine and should therefore be free from the lubricant. A tubular cushion 18 is provided around the lower end portion of each vertical rod 17. The cushions 18 have a length such that the horizontal plate 13 comes into contact with the cushions 18 upon the contact of the left sleeve 8 with the cushion 12.

The second embodiment has the same construction as the first embodiment described. Like parts are designated by like reference numerals will not be repeated.

With the second embodiment as described, the two vertical rods 17 are used as means for preventing the web W from coming into contact with the vertical guide rod 7, whereas a plate, for example, may alternatively be used for surrounding the guide rod 7. However, the vertical rods 17 are preferable to use in view of the cost. From the viewpoint of savings in space, it is also desirable to arrange the vertical rods 17 between the pair of brackets 15 supporting the two dancer rollers 5, 6 as in the foregoing second embodiment.

Although the two embodiments described above has two dancer rollers, the number of rollers is not always limited to two as long as at least one dancer roller is provided.

While one packaging machine is usually equipped with only one accumulator of either of the embodiments, two or more accumulators may be installed.

Although the balls 9 rollably retained by the lift sleeve 8 are provided between the vertical guide rod 7 and the lift sleeve 8 according to the foregoing two embodiments, the balls 9 may be replaced by rollers rollably retained on the lift sleeve 8. When rollers are used, the vertical guide rod is constructed with a polygonal cross-section so that the peripheral surface thereof includes at least two flat faces to be rolled on, and the lift sleeve is adapted to retain the rollers to be rolled on the flat faces and thereby prevented from rotating about the axis of the guide rod.

What is claimed is:

1. A web accumulator comprising an even number of dancer rollers and a guide means for guiding the dancer rollers for upward and downward movement, the guide means comprising:

a single vertical guide rod, the same number of the dancer rollers disposed at each of both sides of said vertical guide rod; and support means for supporting said dancer rollers in a horizontal position.

2. A web accumulator as defined in claim 1, wherein the support means comprises a lift sleeve fitting around the vertical guide rod so as to permit the upward and downward movement of said support means while preventing rotation of said support means about the axis of the guide rod.

3. A web accumulator as defined in claim 2, wherein a plurality of rolling members rollable along the vertical guide rod are provided between the guide rod and the lift sleeve and are rollably retained on the lift sleeve.

4. A web accumulator as defined in claim 3 wherein the rolling members are balls, and the vertical guide rod has a plurality of vertical ball guide grooves formed in an outer periphery thereof and spaced apart circumferentially thereof, the balls being rollable as fitted in the ball guide grooves.

5. A web accumulator as defined in claim 1 further comprising a shield means for preventing the web from coming into contact with the vertical guide rod.

6. A web accumulator as defined in claim 1, wherein said web accumulator comprises only two dancer rollers.

7. A web accumulator as defined in claim 6 wherein the two dancer rollers are identical in construction.

8. A web accumulator as defined in claim 7, wherein the two dancer rollers are arranged in parallel to one another.

9. A web accumulator as defined in claim 6 further comprising a shield means for preventing the web from coming into contact with the vertical guide rod.

10. A web accumulator comprising two dancer rollers and a guide means for guiding the dancer rollers for upward and downward movement, the guide means comprising:

a single vertical guide rod, and support means for supporting said dancer rollers, said support means being movable and downward along an axis of said guide rod without being able to rotate about said axis in a horizontal position, wherein said web accumulator further comprises a shield means for preventing the web from coming into contact with said vertical guide rod, and wherein said shield means comprises vertical rods which are arranged between the two dancer rollers.

11. A web accumulator comprising:

a single vertical guide rod formed in an outer periphery thereof with a plurality of vertical ball guide grooves spaced apart circumferentially thereof;

a lift sleeve fitting around the vertical guide rod so as to be movable upward and downward while being prevented from rotating about an axis of the guide rod;

a plurality of balls provided between the vertical guide rod and the lift sleeve and rollably retained on the lift sleeve, the balls being rollable as fitted in the ball guide grooves in the outer periphery of the guide rod;

a horizontal support plate fixed to an upper end of the lift sleeve and formed at the middle of the length thereof with a hole having the vertical guide rod loosely inserted therethrough, the support plate being formed with two through-holes each greater in diameter than a diameter of the guide rod inserting hole and positioned closer to respective opposite ends of the support plate than the guide rod inserting hole;

two brackets fixed to the respective opposite ends of the support plate;

two dancer rollers arranged in parallel to one another with the vertical guide rod positioned therebetween and supported at opposite ends thereof by the brackets, the dancer rollers being identical in construction; and vertical rods each having a greater diameter than the diameter of the vertical guide rod, arranged on opposite sides of the guide rod and loosely inserted through the respective through-holes of the support plate for preventing a web from coming into contact with the guide rod.

* * * * *